US006604960B2

(12) United States Patent
Liu

(10) Patent No.: US 6,604,960 B2
(45) Date of Patent: Aug. 12, 2003

(54) POWER ADAPTER AND THE POWER CORD TAKE-UP DEVICE THEREOF

(75) Inventor: Chia-Fu Liu, Taoyuan Shien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 0 days.

(21) Appl. No.: 10/012,955

(22) Filed: Dec. 10, 2001

(65) Prior Publication Data

US 2002/0137388 A1 Sep. 26, 2002

(30) Foreign Application Priority Data

Mar. 20, 2001 (TW) ..... 90204175

(51) Int. Cl.[7] ..... H01R 13/72
(52) U.S. Cl. ..... 439/501; 363/142; 363/146
(58) Field of Search ..... 439/501, 76.1, 439/502; 363/142, 146

(56) References Cited

U.S. PATENT DOCUMENTS 3,689,868 A * 9/1972 Snyder ..... 439/501
4,585,194 A * 4/1986 Schwob ..... 439/501
4,940,427 A * 7/1990 Pearson ..... 439/501
5,071,367 A * 12/1991 Luu ..... 439/501
5,783,927 A * 7/1998 Chen ..... 320/110
5,901,056 A * 5/1999 Hung ..... 363/142
6,172,477 B1 * 1/2001 Kim ..... 320/114
6,490,186 B2 * 12/2002 Cho ..... 363/146

* cited by examiner

*Primary Examiner*—Gary Paumen
(74) *Attorney, Agent, or Firm*—Niro, Scavone, Haller & Niro

(57) ABSTRACT

A power adapter is disclosed. The power adapter comprises a housing having an AC inlet, a circuit board installed in the housing and connected with the AC inlet for converting AC to DC, a power cord with one end thereof connected with the circuit board, and a power cord take-up device having a bottom plate and a centered projecting member, wherein a top of the centered projecting member is connected with the housing, so as to wind the power cord around the centered projecting member to receive the power cord in the power cord take-up device.

6 Claims, 3 Drawing Sheets

POWER ADAPTER AND THE POWER CORD TAKE-UP DEVICE THEREOF

FIELD OF THE INVENTION

The present invention is related to a power cord take-up device, and more particularly to a power adapter and the power cord take-up device thereof for receiving a power cord.

BACKGROUND OF THE INVENTION

An electronic appliance, such as a printer, a radio, a modem (modulator-demodulator) and so forth will be equipped with a power adapter for rectifying and converting the commercially available power into direct current (DC) power, so as to supply the required power to operate these electronic appliances.

A prior art power adapter structure is shown in FIG. 1. As depicted in FIG. 1, the prior art power adapter principally comprises a housing 11, wherein one side 111 of the housing 11 acts as a power receiving terminal. A connector 13 is submerged in the slot 12 on the side 111 for matching with a corresponding connector 161. The connector 161 is provided on one end of a power cable 162, while the other end of the power cable 162 is provided with a plug 163. The power adapter of FIG. 1 receives commercially available power by connecting the plug 163 to a wall outlet (not shown). When a consumer purchases a power adapter, generally a bundling strap 15 will be enclosed in the encasement of the power adapter for the purpose of bundling the power cord 14 when the power adapter is no longer used. When one desires to use the power adapter, the bundling strap 15 has to be unfastened in advance and the power cord 14 can be stretched out to connect with a power receiving device (not shown).

The present invention is related to a power adapter, and more particularly to a power adapter having a power cord take-up device for receiving a power cord.

BACKGROUND OF THE INVENTION

An electronic appliance, such as a printer, a radio, a modem (modulator-demodulator) and so forth is generally equipped with a power adapter for rectifying and converting the commercially available alternating current (AC) power into direct current (DC) power, so as to supply the required power to operate these electronic appliances.

A power adapter structure of the prior art is shown in FIG. 1. As depicted in FIG. 1, the power adapter of the prior art principally comprises a housing 11, wherein one side 111 of the housing 11 acts as a power receiving terminal. An AC inlet 13 is inset in the slot 12 on the side 111 for matching with a corresponding connector 161. The connector 161 is provided on one end of a power cable 162, while the other end of the power cable 162 is provided with a plug 163. The power adapter of FIG. 1 receives commercially available AC power by connecting the plug 163 to a wall outlet (not shown). Another side 112 of the housing 11 extends a power cord 14 for providing the converted DC power to an electronic appliance (not shown). When a consumer purchases a power adapter, generally a bundling strap 15 will be enclosed in the encasement of the power adapter for the purpose of bundling the power cord 14 when the power adapter is not used. When one desires to use the power adapter, the bundling strap 15 has to be unfastened in advance and the power cord 14 can be stretched out to connect with an electronic appliance.

A first aspect of the present invention is associated with a power cord take-up device, comprising a housing, a power cord with one end thereof connected with the housing, and a take-up reel having a centered projecting member, wherein a top of the centered projecting member is connected with the housing, so as to wind the power cord around the take-up reel to gather the power cord up by the centered projecting member.

In accordance with the power cord take-up device as described hereinbefore, the housing is indicative of a power adapter housing.

In accordance with the power cord take-up device as described hereinbefore, the housing is further divided into an upper housing and a lower housing.

However, the foregoing power cord take-up mechanism for a power adapter causes some cumbersome problems in practical operation:

1. Because the bundling strap 15 is isolated from the power adapter housing 11, the bundling strap 15 is easily lost.
2. After the bundling strap 15 has been bundled with the power cord 14, the power cord 14 will be suspended over the housing 11, such that the power adapter is not easy to be stored and thus occupies a lot of space.

There is a need to provide a power adapter having a power cord take-up device which is easy to be stored and space-saving.

SUMMARY OF THE INVENTION

An object of the present invention is to provide a power adapter which is designed for solving the problems encountered by the prior art, and it is characterized by enabling the power cord to be received in the power cord take-up device provided on the power adapter, in such a way that the power adapter can be easily stored.

The power adapter as described hereinbefore is further provided with a projecting flange on the take-up reel.

Now the foregoing and other features and advantages of the present invention will be more clearly understood through the following descriptions with reference to the accompanying drawings, in which:

BRIEF DESCRIPTION OF THE DRAWINGS

FIG. 2(*b*) is an elevation view showing the power cord take-up device according to a preferred embodiment of the present invention.

DETAILED DESCRIPTION OF THE PREFERRED EMBODIMENT

An exemplary embodiment of the power adapter and the power cord take-up device thereof of the present invention now will be fully described with reference to the following preferred embodiment. It is to be emphasized that the following descriptions of embodiments and examples of the present invention is only illustrative, and it is not intended to be exhaustive or not to be limited to the precise form disclosed.

A first aspect of the present invention is associated with a power adapter, comprising a housing having an AC inlet, a circuit board installed in the housing and connected with the AC inlet for converting AC to DC, a power cord with one end thereof connected with the circuit board, and a power cord take-up device having a bottom plate and a centered projecting member, wherein a top of the centered projecting member is connected with the housing, so as to wind the power cord around the centered projecting member to receive the power cord in the power cord take-up device.

In accordance with the power cord take-up device as described hereinbefore, the housing is indicative of a power adapter housing.

In accordance with the power adapter as described hereinbefore, the housing is further divided into an upper housing and a lower housing.

In accordance with the power adapter as described hereinbefore, the alternating current (AC) inlet is further provided between the upper housing and the lower housing.

In accordance with the power adapter as described hereinbefore, the power cord take-up device further comprises a projecting flange on the edge of the bottom plate.

A second aspect of the present invention is in connection with a power adapter comprising an upper housing, a lower housing for being coupled with the upper housing, an AC inlet inset between the upper housing and the lower housing, a circuit board installed between the upper housing and the lower housing and connected with the AC inlet for converting AC to DC, a power cord with one end thereof connected with the circuit board, and power cord take-up device having a bottom plate and a centered projecting member, wherein a top of the centered projecting member is connected with the housing, so as to wind the power cord around the centered projecting member to receive the power cord in the power cord take-up device.

The power adapter as described hereinbefore, the power cord take-up device further comprises a projecting flange on the edge of said bottom plate.

Now the foregoing and other features and advantages of the present invention will be more clearly understood through the following descriptions with reference to the accompanying drawings, in which:

BRIEF DESCRIPTION OF THE DRAWINGS

Figure 1:
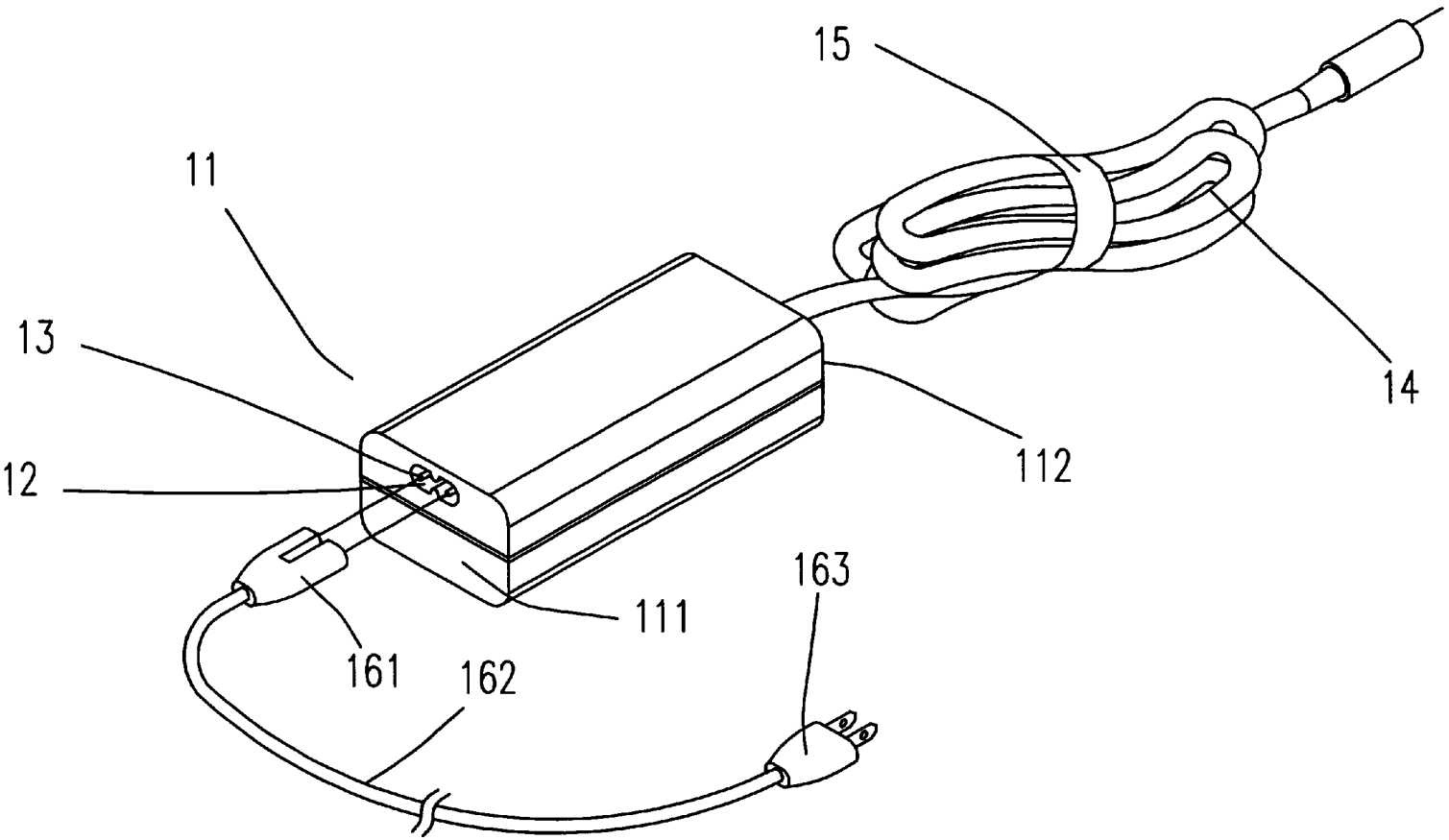
Fig. 1(PRIOR ART)
FIG. 1 is an elevation view showing the power cord take-up device of the prior art.
Figure 2A:
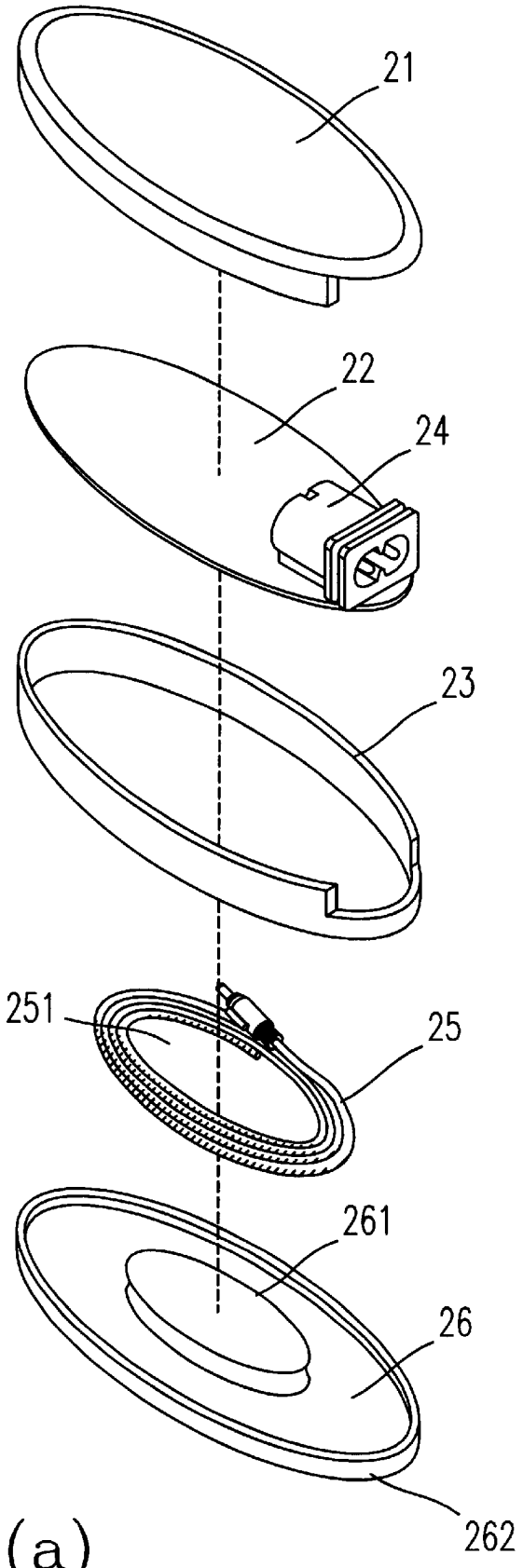
FIG. 2(*a*) is an exploded view showing the power cord take-up device according to a preferred embodiment of the present invention.
Figure 2B:
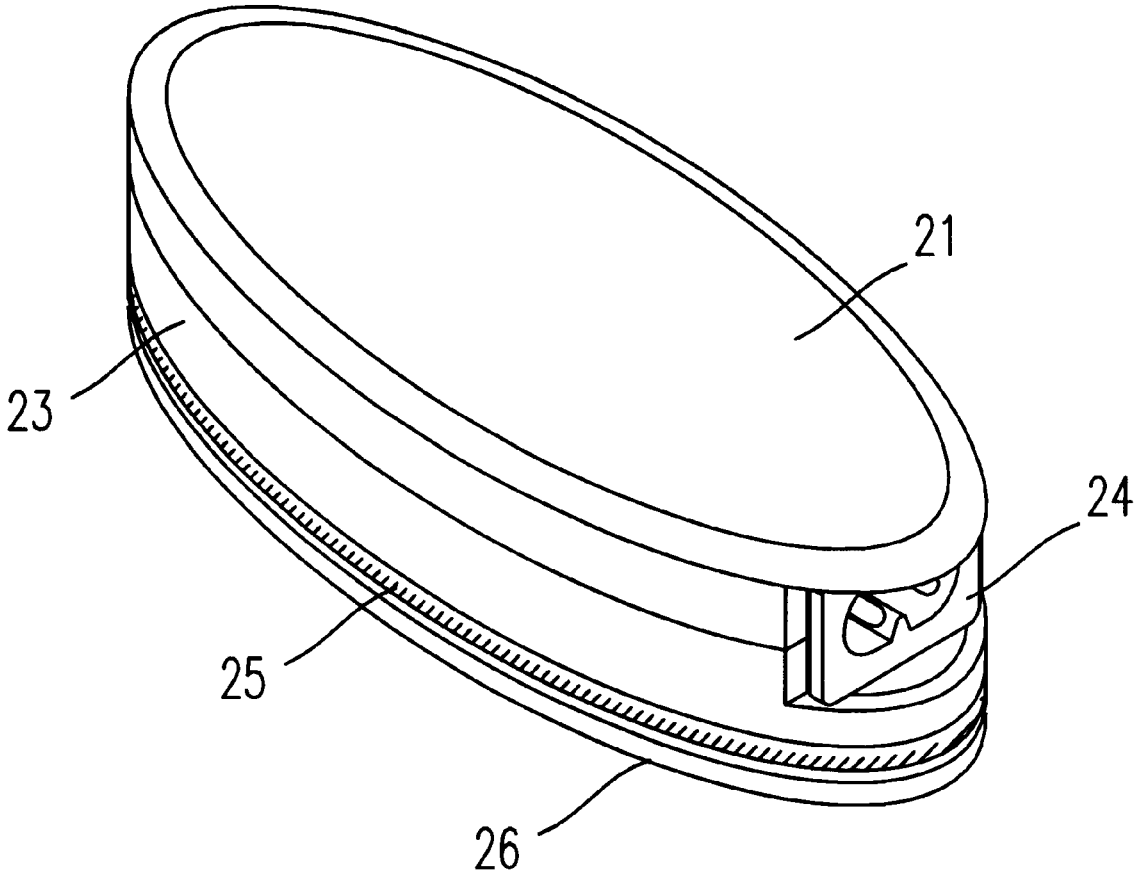

FIG. 1 is a schematic view showing the power adapter of the prior art;

FIG. 2(*a*) is a schematic view showing the dissembled structure of the power adapter according to a preferred embodiment of the present invention; and FIG. 2(*b*) is a schematic view showing the assembled structure of the power adapter according to a preferred embodiment of the present invention.

An exemplary embodiment of the power adapter having the power cord take-up device thereof of the present invention now will be fully described with reference to the following preferred embodiment. It is to be emphasized that the following descriptions of embodiments and examples of the present invention is only illustrative, and it is not intended to be exhaustive or not to be limited to the precise form disclosed.

FIG. 2(*a*) and FIG. 2(*b*) respectively depicts the dissembled and the assembled structures of the power adapter with power cord take-up device according to a preferred embodiment of the present invention. The power adapter of the present invention includes an upper housing 21, a circuit board 22, a lower housing 23, an alternating current (AC) inlet 24, a power cord 25 and a power cord take-up device 26. The AC inlet 24 is inset between the upper housing 21 and the lower housing 23. One end 251 of the power cord 25 is connected to the circuit board 22. The power cord take-up device 26 has a bottom plate 263 and a centered projecting member 261 which has a top to be connected with the lower housing 23 (certainly, the power cord take-up device 26 and the projecting member 261 can be connected with upper housing 21). The power cord take-up device 26 further includes a projecting flange 262 on the edge of the bottom plate for enabling the entwined power cord 25 to be fixed in position onto the power cord take-up device 26.

To conclude, the present invention is characterized by that the power cord take-up device 26 comprising the projecting member 261 is connected with the power adapter housing, and the power cord 25 is winded around the projecting member 261 of the power cord take-up device 26. Therefore, the power adapter and the power cord take-up device thereof has

What is claim is:

1. A power adapter comprising:

a housing having an AC inlet;

a circuit board installed in said housing and connected with said AC inlet for converting an AC power to a DC power;

a power cord with one end thereof connected with said circuit board; and a power cord take-up device having a bottom plate and a centered projecting member, wherein a top of said centered projecting member is connected with said housing, so as allow winding of said power cord around said centered projecting member to receive said power cord in said power cord take-up device.

2. A power adapter of claim 1 wherein said housing comprises an upper housing and a lower housing.

3. A power adapter of claim 2, wherein said AC inlet is inset between said upper housing and said lower housing.

4. A power adapter of claim 1 wherein said power cord take-up device further comprises a projecting flange on the edge of said bottom plate.

5. A power adapter comprising:

an upper housing;

a lower housing being coupled with said upper housing;

an AC inlet inset between said upper housing and said lower housing;

a circuit board installed between said upper housing and said lower housing and connected with said AC inlet for converting an AC power to a DC power;

a power cord with one end thereof connected with said circuit board; and a power cord take-up device having a bottom plate and a centered projecting member, wherein a top of said centered projecting member is connected with said housing, so as allow winding of said power cord around said centered projecting member to receive said power cord in said power cord take-up device.

6. A power adapter of claim 5 wherein said power cord take-up device further comprises a projecting flange on the edge of said bottom plate.

* * * * *